United States Patent [19]

Menet et al.

[11] Patent Number: 4,886,992

[45] Date of Patent: Dec. 12, 1989

[54] ELECTRON SOURCE WITH MAGNETIC MEANS

[75] Inventors: Jacques Menet, Saint-Egreve; Olivier de Gabrielli, Grenoble, both of France

[73] Assignee: Centre National De La Recherche Scientifique, Paris, France

[21] Appl. No.: 221,681

[22] Filed: Jul. 20, 1988

[30] Foreign Application Priority Data

Jul. 22, 1987 [FR] France ..... 87 10642

[51] Int. Cl.[4] ..... H01J 1/50

[52] U.S. Cl. ..... 313/153; 313/618

[58] Field of Search ..... 313/153, 618, 597, 313, 313/339, 231.31, 359.1, 363.1

[56] References Cited

U.S. PATENT DOCUMENTS 3,381,157 4/1968 Ferreira ..... 313/618 X
4,633,129 12/1986 Cuomo et al. ..... 313/153

FOREIGN PATENT DOCUMENTS 1281964 12/1962 France .
2498010 7/1982 France .

*Primary Examiner*—Kenneth Wieder
*Attorney, Agent, or Firm*—Lowe, Price, Leblanc, Becker & Shur

[57] ABSTRACT

The instant invention relates to an electron source which contains, in a low pressure chamber, an anode (A), a cathode (K) and means for applying a magnetic field (13). The cathode is constituted by an equipotential cavity (10) provided with an aperture (11) on the side of the anode. The magnetic field is applied parallel to the anode-cathode direction at the aperture.

5 Claims, 1 Drawing Sheet

ELECTRON SOURCE WITH MAGNETIC MEANS

BACKGROUND OF THE INVENTION

The instant invention relates to an electron source for an electron gun.

In the prior art, two main types of electron guns are used, sorted according to the type of the electron source, that is, those provided with a thermoelectronic source and those provided with a plasma source.

In the electron guns with a thermoelectronic source, electrons are created by a solid heated at a high temperature. The main drawback of this type of device is the relatively low lifetime of the filament. In order to increase the lifetime, it is necessary, on the one hand, to provide for very sophisticated materials used for example in the cathodes of the electronic tubes and, on the other hand, to reduce as much as possible the pressure in the electron generation area. One thus tries to obtain pressures lower than $10^{-5}$ Torr (about $10^{-3}$ Pa), which requires very sophisticated vacuum equipment.

FIG. 1 schematically shows an electron gun with a plasma source. This electron gun comprises a cathode plate K positioned in front of an anode plate A. The electrical field and gas pressure conditions between the cathode and the anode are chosen for obtaining a glow discharge in the area included between those plates. In practice, this means that there must be a minimal field in the range of a few hundreds V/cm and a pressure in the range of 1 to 10 Pa. Thus, a plasma P is generated between the cathode and the anode and the electrons hit the anode plate. This anode plate A is provided with a central aperture through which the electrons can escape; they are then accelerated by various means towards a collecting plate C. For obtaining an accelerating area with a sufficient length, the pressure in the area included between the anode plate A and the collecting plate C must be sufficiently low. For example, for obtaining a free average path of the electrons of 20 cm, the pressure must be lower than 0.1 Pa.

The structure of FIG. 1 is schematically drawn. In practical devices, numerous improvement are provided, for example intermediary electrodes between the cathode and the anode. Those electrodes can be of the grid type. Similarly, for maintaining a good focussing of the electron beam in the accelerating area, magnetic fields parallel to the electron propagation direction are sometimes provided.

Those plasma electron sources present, with respect to the thermoelectronic sources, the advantage of providing a larger lifetime and an operating ability at a higher pressure (1 to 10 Pa instead of $10^{-4}$ to $10^{-3}$ Pa).

However those plasma sources still present several drawbacks.

A first drawback is due to the fact that, a plasma being generated in the whole area included between the cathode and the anode, the device yield is necessarily lower than the unit since a portion of the electrons will hit the anode plate A. This loss can be lowered by using, instead of a plain aperture as schematically shown in FIG. 1, a transparent anode system provided with a magnetic focussing. However, yields lower than the unit are still obtained, for example in the range of 70%.

Another drawback is due to the fact that the plasma generation area between the cathode and the anode and the accelerating area between the anode A and the accelerating plate C must necessarily have different pressures: the second area must have a lower pressure than the first one. Therefore, sophisticated differential pumping systems are to be used for optimizing the pressures in each area. This is usually carried out by injecting a gas into the cathode-anode area and by pumping in the accelerating plate-anode area.

Thus, an object of the instant invention is to provide for a new type of plasma electron source palliating the hereinabove mentioned drawbacks of the conventional plasma electron sources.

SUMMARY OF THE INVENTION

In order to achieve this object and others, the instant invention provides for an electron source comprising, in a low pressure chamber, an anode, a cathode and means for applying a magnetic field, wherein the cathode is constituted by an equipotential cavity provided with an aperture on the side of the anode, and a magnetic field parallel to the anode-cathode direction is applied at the aperture.

According to an embodiment of the invention, the pressure in the chamber is in the range of a few tenths of a pascal.

According to an embodiment of the invention, the voltage applied between the anode and the cathode is in the range of a few hundreds volts/cm.

According to an embodiment of the invention, the magnetic field is in the range of a few hundredths tesla.

According to an embodiment of the invention, the aperture is a very elongated slit.

Thus, the device according to the instant invention permits an electron gun having in particular the following advantages:

- a theoretical yield equal to 1;
- a delimitation of the electron beam independently of the anode and focussing structures;
- an ability to operate with a pressure in the range of a few tenths of pascal in the plasma generation area, which is compatible with the pressure allowed in the accelerating area.

BRIEF DESCRIPTION OF THE DRAWINGS

Other advantages and features of the instant invention will clearly appear from the following detailed description of a preferred embodiment, in connection with the attached drawings, wherein.

DETAILED DISCLOSURE OF THE INVENTION

The electron source according to the invention comprises a cathode K and an anode A. Cathode K is constituted by an equipotential cavity 10 provided with an aperture 11 on the side of anode A. Means, for example permanent magnets, are provided for applying a magnetic field B in the cathode-anode direction at aperture 11.

Figure 1:
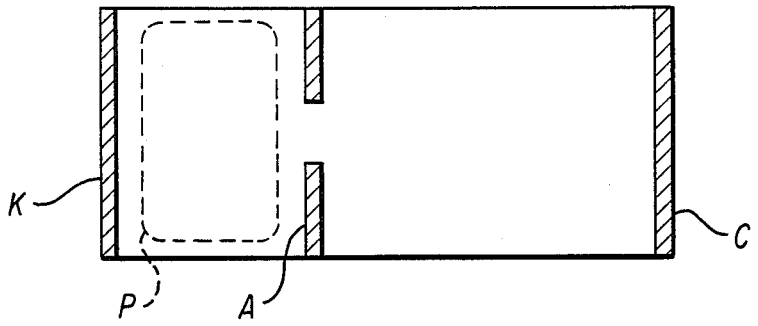
FIG. 1 PRIOR ART
FIG. 1 illustrates a plasma source according to the prior art has been disclosed hereinabove.
Figure 2:
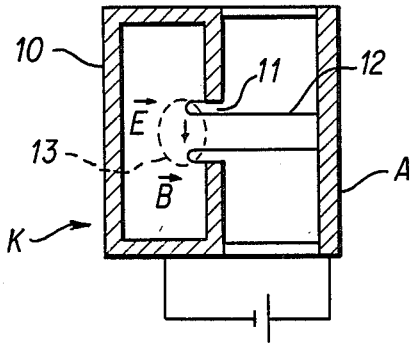
FIG. 2 very schematically shows an embodiment of an electron source according to the invention.

When an electrical field is applied between the anode and the cathode due to the presence of a cavity, the electrical field lines 12 are curved inward at the aperture, as shown in FIG. 2. Thus, there are areas when the electrical field, because of the curvature of the field lines, is perpendicular to the anode-cathode direction, that is, perpendicular to the applied magnetic field B.

As a result, a plasma is generated for gas pressures much lower than when such electrical and magnetic cross fields do not exist. Indeed, the edge effects (curvature of the electrical field due to the presence of an aperture in the cavity), cumulated with the magnetic cross field in some places, initiate the plasma creation. A plasma area 13, much alike the one delimited by the dotted lines of FIG. 2 at the neighborhood of aperture 11, is thus produced, for gas pressures exceeding a few tenths of pascal. Some electrons of this plasma are then drawn by the anode A as a hollow beam.

As a result, numerous advantages for the source according to the invention are obtained:

the plasma is created whatever the shape and the size of the aperture may be. Apertures having very large sizes can then be provided, for example elongated slits;

the yield between the current of the electrons and the discharge current approaches 100%;

the plasma can be created at a pressure in the range of a few tenths of pascal;

the system has a very simple structure and a low manufacturing cost with respect to the conventional electron guns.

Figure 3:
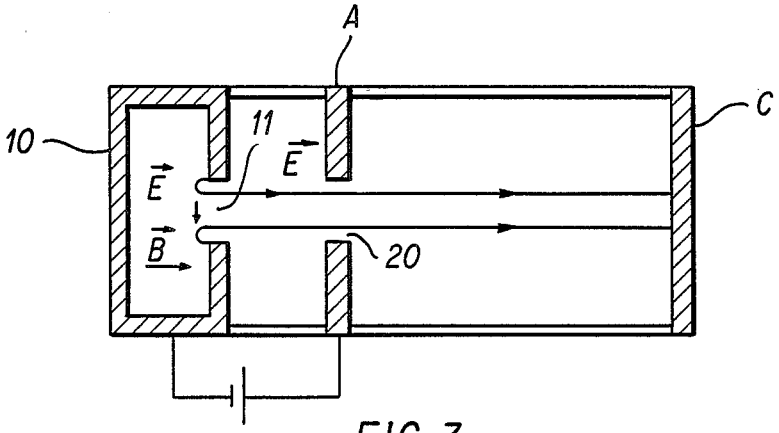
FIG. 3 very schematically shows an embodiment of an electron gun according to the invention.

FIG. 3 shows a plasma electron source according to the instant invention associated with an accelerating cavity. Cathode K constituted by a cavity 10 and anode A are shown again in FIG. 3. Anode A is provided with an aperture 20 for letting the electrons flow towards an accelerating electrode C. Of course, instead of an aperture 20 having a similar shape as that of the aperture in cathode 10, a transparent anode could be provided, that is, for example an anode constituted by a grid.

An advantage of the instant invention in relation with an accelerating cavity is particularly due to the fact that the whole set can operate at a single pressure and therefore it is no longer necessary to provide for sophisticated pumping systems.

In an embodiment of the invention, the cathode cavity can be rectangular with a width of 50 mm and a depth of 10 mm, the slit having a width of a few mm and a length of 100 mm. The anode-cathode voltage is about 400 V and the magnetic field in the range of $8\times10^{-2}$ tesla, the intensity of the electron beam being of 1.5 A.

It will be understood by those skilled in the art that numerous variations may be made without departing from the spirit and scope of the invention. In particular, conventional improvements to plasma electron sources can be made to the source of the invention. More particularly, intermediary grids can be provided in the cathode-anode area, more sophisticated focussing systems can be provided in the accelerating area, and, if it is so desired, a pressure difference between the plasma creation area and the accelerating area can be provided for, and this pressure difference will be more easily applied than in the prior art due to the presence of a lower pressure in the plasma creation area.

We claim:

1. A plasma electron source in a low pressure chamber comprising:

an anode;

an equipotential cavity cathode structure, said cathode structure including a front plate facing said anode said front plate provided with an aperture; and means for applying at said aperture a magnetic field perpendicular to said front plate.

2. An electron source according to claim 1, wherein the pressure in the chamber is in the range of a few tenths of pascal.

3. An electron source according to claim 2, wherein the electrical field applied between the anode and the cathode is in the range of a few hundredths volts cm.

4. An electron source according to claim 1, wherein said magnetic field is exceeding a few hundredths tesla.

5. An electron source according to claim 1, wherein said aperture is a very elongated slit.

* * * * *